United States Patent [19]

Kitano et al.

[11] Patent Number: 4,647,744

[45] Date of Patent: Mar. 3, 1987

[54] ROTATING HEATING ROLLER OF THE TYPE HAVING A THREE PHASE CIRCUMFERENTIALLY LAMINATED LEG CORE

[75] Inventors: Senjin Kitano; Hiroki Tsutsumi, both of Kyoto, Japan

[73] Assignee: Tokuden Co., Ltd., Kyoto, Japan

[21] Appl. No.: 753,679

[22] Filed: Jul. 10, 1985

[30] Foreign Application Priority Data

Jul. 30, 1984 [JP] Japan ..... 59-157366

[51] Int. Cl.[4] ..... H05B 6/14

[52] U.S. Cl. ..... 219/10.49 A; 219/10.61 A; 219/10.71; 219/10.75; 219/10.79

[58] Field of Search ..... 219/10.49 A, 10.49 R, 219/10.61 A, 10.61 R, 10.71, 10.75, 10.77, 10.41, 10.79, 10.43, 10.69, 10.67, 469, 470, 471; 336/183

[56] References Cited

U.S. PATENT DOCUMENTS

| | | | |
|---|---|---|---|
| 2,748,240 | 5/1956 | McArthur | 219/10.75 |
| 2,849,584 | 8/1958 | Tudbury | 219/10.75 |
| 3,200,230 | 8/1965 | La Bretoniere | 219/10.61 A |
| 3,485,986 | 12/1969 | Ross | 219/10.79 |
| 3,487,187 | 12/1969 | Martens et al. | 219/10.61 A |
| 3,562,472 | 2/1971 | Cannon | 219/10.61 A |
| 4,472,616 | 9/1984 | Maurice et al. | 219/10.79 X |

*Primary Examiner*—Philip H. Leung
*Attorney, Agent, or Firm*—Michael J. Striker

[57] ABSTRACT

A rotating heating roller includes a laminated core and four circumferential yokes provided on the core. A three-phase winding is mounted on the leg core between the yokes. The winding is divided into three coils and adjacent end parts of the coils are overlapped. These overlapped coil parts generate a higher induced electromotive force when excited than that of the non-overlapped coil parts. The higher electromotive force contributes to a uniform distribution of the surface temperature of the rotating roller.

3 Claims, 6 Drawing Figures

Fig. 4 (1)
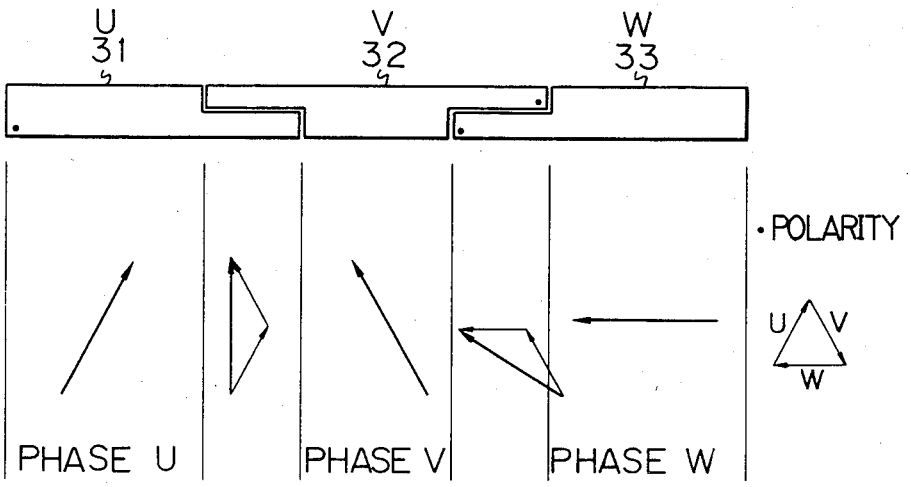
Fig. 4 (2)
Fig. 5
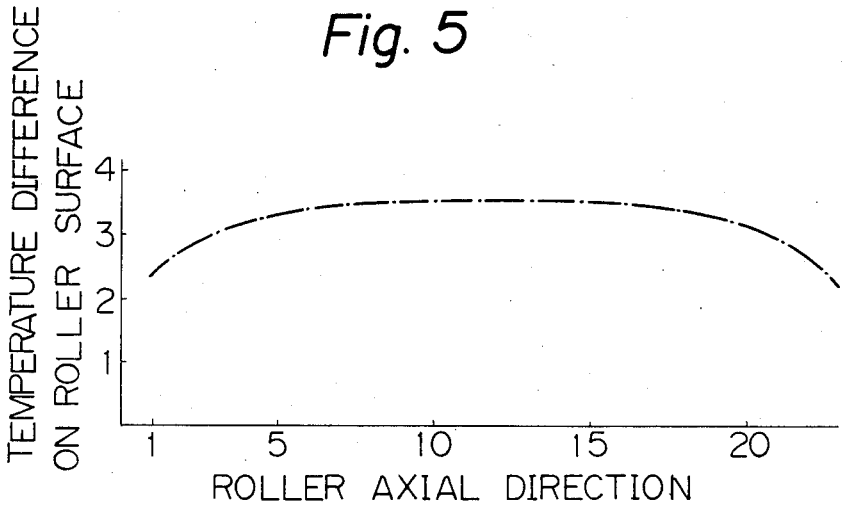

ROTATING HEATING ROLLER OF THE TYPE HAVING A THREE PHASE CIRCUMFERENTIALLY LAMINATED LEG CORE

BACKGROUND OF THE INVENTION

1. Field of the Invention

This invention relates generally to a rotating heating roller of the type having a three phase core and more particularly to such a rotating roller which includes a circumferentially laminated tubular core provided within the jacket of the rotating roller, four circumferential yokes provided on the core at the positions where the core is equally divided into three equal sections when viewed in the axial direction of the core and at the positions where the core terminates, three windings provided on the leg core between the yokes.

2. Description of the Prior Art

In the process of continuous rolling of a sheet material, it is most important to keep temperature distribution on the rotating heating roller in order to apply a constant and uniform nipping pressure on a sheet material or a web material processed by the roller. The surface temperature of the roller is required to be uniform in order to avoid any defect of the quality of the treated products caused by the temperature difference on the surface of the roller.

In order to keep the surface temperature of a roller uniform, prior construction proposed to locate an iron core coaxial with the roller and to arrange an electromagnetic coil wound outside the core within the interior of the roller. In this construction, a magnetic flux is generated in the core along the direction of the axis of the roller inasmuch as the electromagnetic coil is excited by an alternating current source and the magnetic flux passes through a closed magnetic circuit which surrounds the periphery of the roller. An electromotive force is induced in the roller by the magnetic flux because the roller acts as a one-turn coil. An electric current is generated in the peripheral direction of the roller by the electromotive force and the roller is heated by the Joule's heat of the current.

In the prior art, when heat generation is needed in a rotating roller, a heat generating element is unevenly embeded within the rotating roller so that the surface temperature of the roller is made uniform in the direction along the axis of the roller. With this prior art construction of the roller, heat generation is not kept uniform when the heat generating element wears down with time.

In another prior art, the outer surface of a magnetic cylinder is tightly affixed to the inner surface of the roller and a copper ring is provided between gaps of the magnetic cylinder so as to control the secondary short circuit current that flows within the roller along the inner thereof and within the copper ring. With this prior construction of the roller, the surface temperature distribution is made better out the mechanism is very complicated.

SUMMARY OF THE INVENTION

According to this invention, a tubular core is provided on a stationary shaft of a rotating roller within a jacket of the rotating roller. The core is laminated in the axial direction of the shaft.

Circumferential yokes are provided on the leg core at four positions, that is, a first position is at one end of the core, a second position is at the other end of the core, and a third position and a fourth position are at intermediate points where the core is divided into three parts. The circumferential yokes are also laminated in the direction perpendicular to axis of the shaft.

Three windings are wound on the shaft between respective yokes. An end part of a first winding is overlapped by an end part of a second winding, an end part of a third winding is overlapped by the other end part of the second winding so that the overlapped parts of the three windings cross the intermediate circumferential yokes whereby the electromotive force generated at the overlapped parts of the windings is made higher than that generated at the parts where the windings are not overlapped.

The circumferential yokes are laminated in the direction perpendicular to the shaft of the rotating jacket of the roller and, therefore, circulating current is prevented from being generated in the laminated core sections and the circumferential yokes.

It is the primary object of the present invention to provide a rotating heating roller in which the surface temperature distribution is uniform.

It is another object of the present invention to provide a rotating roller of the type having a shaft provided with a laminated core supporting three phase windings which are partially overlapped so as to superimpose the magnetic flux generated by the overlapped windings and to make the voltage induced by the overlapped windings higher than the voltage induced by the non-overlapped windings.

The foregoing objects and other objects as well as the characteristics features of the present invention will become more apparent and more readily understandable by the following description and the appended claims when read in conjunction with the accompanying drawings.

BRIEF DESCRIPTION OF THE DRAWINGS

In the drawings, like reference characters designate the same or similar parts throughout the figures thereof and wherein.

FIG. 4(1) shows the polarity of the three phase winding shown in FIG. 3;

FIG. 4(2) illustrates vector diagrams of the induced voltages generated in the three phase winding; and FIG. 5 is a diagram showing temperature distribution on the surface of the rotating roller of FIG. 3.

DESCRIPTION OF THE PREFERRED EMBODIMENT

Figure 1:
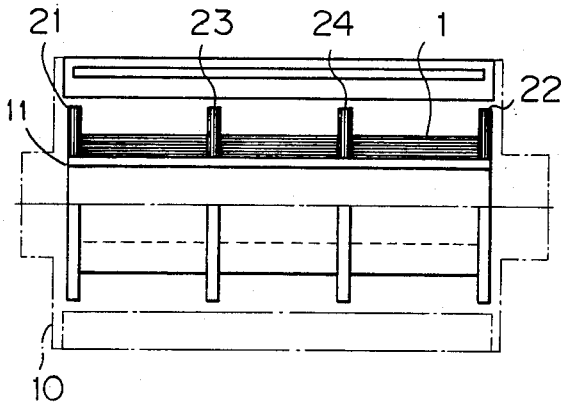
FIG. 1 is a plan view partly in section of a rotating heating roller of the type having a laminated core embodying this invention.
Figure 2:
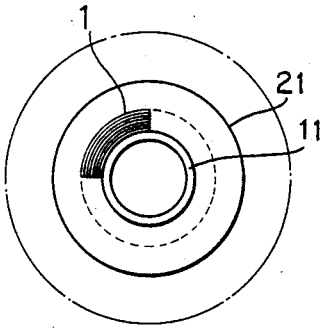
FIG. 2 is an elevational view, partly in section, of the roller of FIG. 1.

In FIGS. 1 and 2, tubular core 1 is made of laminated iron sheets wound around a stationary shaft 11 made of soft steel sheets and is housed in the interior of rotating jacket 10 is also made of soft steel. Circumferential yokes 21 and 22 made of laminated iron sheets are, respectively, provided at the ends of the core 1. Circumferential yokes 23 and 24 also made of laminated iron sheets are, respectively, provided at the positions where the core 1 is equally divided into three parts in the direction along the center line of the shaft 11.

The laminate of the yokes 21 to 24 are oriented in the direction perpendicular to the center line of the shaft 11 so that the circulating current is prevented from being generated in the yokes. The core 1 is circumferentially laminated in the direction along the center line of the shaft 11 so that the circulating current is also constrained from being generated in the core 1.

Figure 3:
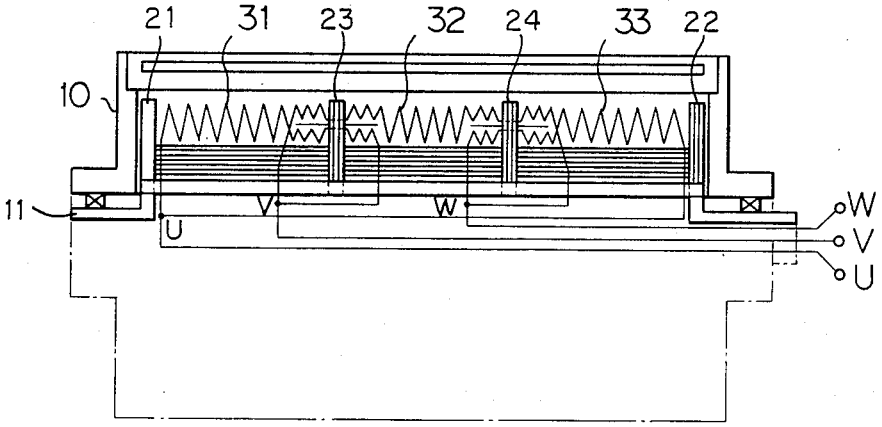
FIG. 3 is a sectional plan view of the rotating roller shown in FIG. 1 wherein a three phase winding is wound on the core.

In FIG. 3, coils 31, 32 and 33 that constitute a three phase winding, are, respectively, wound between the yoke 21 and the yoke 23, the yoke 23 and the yoke 24 and the yoke 24 and the yoke 22. The coil 31 wound between the yoke 21 and the yoke 23 is referred to as a U phase coil, the coil 32 wound between the yoke 23 and the yoke 24 is referred to as a V phase coil and the coil 33 wound between the yoke 24 and the yoke 22 is referred to as a W phase coil.

The right end of the U phase coil 31 is overlapped on the left end by a part of the V phase 32, and the left end of the W phase coil 33 is overlapped on the right end by a part of the V phase coil 32.

In FIG. 4(1), the positions of the U phase coil 31, the V phase coil 32 and the W phase coil 33 and the relation of the overlapped coil parts are shown. In FIG. 4(2), the induced voltages generated by the three phase winding are shown by vectors and the voltages generated by the overlapped coil parts are shown by vector sums. The vector sums show that the magnetic flux generated by the overlapped coil parts is higher than the magnetic flux generated by the non-overlapped coil parts and the higher magnetic flux yields naturally a higher temperature rise.

As shown in FIG. 5, the surface temperature distribution of the rotating roller is substantially uniform in the direction of the roller axis through constraining the circulating current generated in the laminated core 1 and in the circumferential yokes and through increasing the induced voltage by superimposing the magnetic flux generated by one winding to the magnetic flux generated by the other winding that is overlapped on the one winding.

We claim:

1. A heating roller having a magnetisable jacket supported for rotation about an axis, comprising a magnetisable tubular core coaxially arranged within said jacket, said core being assembled of a series of circumferentially laminated core sections whose laminae extend in the direction of said axis and are spaced from one another in a radial direction; at least three circumferential yokes of a laminated magnetisable material arranged within said jacket at the ends of said core and between said core sections so as to divide said core sections, laminae of said yokes extending in a direction perpendicular to said axis; a multiphase winding mounted on said core to induce heating current in said jacket, said winding including at least two coils wound between corresponding yokes, and adjacent end parts of said coils passing through the adjacent yoke and overlapping one another.

2. A heating roller as defined in claim 1 wherein the overlapped coil end parts generate a higher induced current in said jacket than that generated by the non-overlapped coil parts thus rendering the distribution of surface temperature on said jacket substantially uniform.

3. A heating roller as defined in claim 1 wherein said core is assembled of three core sections and being provided with four circumferential yokes, said winding being a three-phase winding, and the ends of said adjacent end parts being electrically connected one to another.

* * * * *